US008830127B2

(12) United States Patent
Fujiwara

(10) Patent No.: US 8,830,127 B2
(45) Date of Patent: Sep. 9, 2014

(54) PATCH ANTENNA AND METHOD OF MOUNTING THE SAME

(75) Inventor: Hiroyuki Fujiwara, Hanno (JP)

(73) Assignee: Casio Computer Co., Ltd, Tokyo (JP)

( * ) Notice: Subject to any disclaimer, the term of this patent is extended or adjusted under 35 U.S.C. 154(b) by 312 days.

(21) Appl. No.: 13/282,565

(22) Filed: Oct. 27, 2011

(65) Prior Publication Data

US 2012/0127037 A1 May 24, 2012

(30) Foreign Application Priority Data

Nov. 18, 2010 (JP) ..... 2010-257387
Nov. 18, 2010 (JP) ..... 2010-257388

(51) Int. Cl.
*H01Q 9/04* (2006.01)

(52) U.S. Cl.
CPC ..... *H01Q 9/0407* (2013.01); *H01Q 9/045* (2013.01)
USPC ..... 343/700 MS

(58) Field of Classification Search
USPC ..... 343/700 MS, 702, 846, 848
See application file for complete search history.

(56) References Cited

U.S. PATENT DOCUMENTS

| | | | | |
|---|---|---|---|---|
| 7,009,563 | B2 * | 3/2006 | Mori et al. | 343/700 MS |
| 2008/0238782 | A1 * | 10/2008 | Hsu et al. | 343/700 MS |
| 2009/0009270 | A1 * | 1/2009 | Rivas et al. | 333/238 |
| 2011/0260928 | A1 * | 10/2011 | Ito et al. | 343/700 MS |

FOREIGN PATENT DOCUMENTS

| | | |
|---|---|---|
| JP | 07-249632 | 9/1995 |
| JP | 2005-260875 | 9/2005 |
| JP | 2008-078895 | 4/2008 |

OTHER PUBLICATIONS

Japanese Office Action for Japanese Application No. 2010-257387 mailed on Sep. 4, 2012.
Japanese Office Action for Japanese Application No. 2010-257388 mailed on Sep. 4, 2012.

* cited by examiner

*Primary Examiner* — Tan Ho
(74) *Attorney, Agent, or Firm* — Amin, Turocy & Watson, LLP

(57) ABSTRACT

A patch antenna including: a dielectric substrate having a vertical through-hole and a recess that is open downward, the recess having an inner periphery greater than a diameter of the through-hole, the recess being connected to the through-hole; a radiation electrode provided on an upper surface of the dielectric substrate; a ground electrode provided on a lower surface of the dielectric substrate; and a feed pin inserted into the through-hole such that a lower end portion of the feed pin is arranged inside the recess, the feed pin electrically connected to the radiation electrode through an upper end portion of the feed pin, wherein first solder is applied to the lower end portion of the feed pin, and a lower end of the feed pin and a lower end of the first solder are flush with or above a lower surface of the ground electrode.

7 Claims, 8 Drawing Sheets

PATCH ANTENNA AND METHOD OF MOUNTING THE SAME

CROSS-REFERENCE TO RELATED APPLICATIONS

This application is based upon and claims the benefit of priority from the prior Japanese Patent Application No. 2010-257387, filed Nov. 18, 2010 and Japanese Patent Application No. 2010-257388, filed Nov. 18, 2010, and the entire contents of which are incorporated herein by reference.

BACKGROUND OF THE INVENTION

1. Field of the Invention

The present invention relates to a patch antenna and a method of mounting the same.

2. Description of Related Art

A conventional patch antenna has a radiation electrode on the upper surface of a dielectric substrate provided with a vertical through-hole, and a ground electrode on the lower surface of the dielectric substrate. The upper end portion of a feed pin inserted into the through-hole is electrically connected with the radiation electrode by solder. The lower end portion of the feed pin is arranged inside a recess in the lower surface of the dielectric substrate, the recess having an inner periphery greater than the diameter of the through-hole. The lower end of the feed pin is substantially flush with the lower surface of the ground electrode. The patch antenna is thus ready to be surface-mounted (e.g., Japanese Unexamined Patent Application Publication No. 2005-260875).

In order to surface-mount the patch antenna disclosed in Japanese Unexamined Patent Application Publication No. 2005-260875 on a mounting board, the lower end of the feed pin of the patch antenna is put into contact with the feed pad of the mounting board. Alternatively, cream solder is applied on the feed pad of the mounting board in advance, and then the cream solder is melted by heat so that the melted solder climbs along the feed pin. This electrically connects the lower end portion of the feed pin of the patch antenna and the feed pad of the mounting board. In the latter method using the cream solder, the recess in the lower surface of the dielectric substrate ensures a space to firmly attach a conductive material, such as solder, to the feed pin and prevents the solder from coming into contact with a ground electrode.

With the patch antenna disclosed in Japanese Unexamined Patent Application Publication No. 2005-260875, the lower end of the feed pin is substantially flush with the lower surface of the ground electrode, as described above. In the former method, the feed pin cannot completely come into contact with the feed pad in some cases after the patch antenna is placed on the mounting board.

Specifically, in the case where the dielectric substrate and/or the ground electrode of the patch antenna are not flat or the feed pad on the upper surface of the mounting board is not flat, the lower end of the feed pin may fail to come into contact with the feed pad.

Due to the same reason, the lower end of the feed pin and the cream solder also cannot be appropriately in contact with each other in the latter method in some cases. Thus, the melted solder does not climb along the feed pin adequately, leading to failure to form a preferable solder fillet.

Slightly projecting the lower end portion of the feed pin from the lower surface of the ground electrode to prevent such circumstances may damage the feed pin since the projection of the feed pin comes into contact with some external object during transportation. Furthermore, projecting the lower end portion of the feed pin from the lower, surface of the ground electrode may damage the feed pad since the lower end of the feed pin strongly comes into contact with the feed pad before the other portions of the patch antenna come into contact therewith when the patch antenna is placed on the mounting board.

In addition, the patch antenna may be tilted at the pivoting contact point of the feed pin and the feed pad, thus leading to mounting of the patch antenna in the tilted state.

SUMMARY OF THE INVENTION

In view of the circumstances, an object of the present invention is to provide a patch antenna and a method of mounting such an antenna that prevents damage to a feed pin and that can achieve highly reliable surface mounting.

According to an aspect of the present invention, there is provided a patch antenna including: a dielectric substrate having a vertical through-hole and a recess that is open downward, the recess having an inner periphery greater than a diameter of the through-hole, the recess being connected to the through-hole; a radiation electrode provided on an upper surface of the dielectric substrate; a ground electrode provided on a lower surface of the dielectric substrate; and a feed pin inserted into the through-hole such that a lower end portion of the feed pin is arranged inside the recess, the feed pin electrically connected to the radiation electrode through an upper end portion of the feed pin, wherein first solder is applied to the lower end portion of the feed pin, and a lower end of the feed pin and a lower end of the first solder are flush with or above a lower surface of the ground electrode.

According to another aspect of the present invention, there is provided a method of mounting a patch antenna on a mounting board, the patch antenna including a dielectric substrate having a vertical through-hole, a radiation electrode provided on an upper surface of the dielectric substrate, a ground electrode provided on a lower surface of the dielectric substrate, and a feed pin inserted into the through-hole; by electrically connecting a lower end portion of the feed pin to a feed pad provided on an upper surface of the mounting board, the method including: setting a length of the feed pin such that an upper end portion thereof projects from an upper surface of the radiation electrode when a lower end of the feed pin comes into contact with the feed pad; loosely fitting the feed pin into the through-hole; temporarily fixing the feed pin by using third solder applied from the upper end portion of the feed pin to the radiation electrode in a state where the lower end of the feed pin is flush with or above a lower surface of the ground electrode; placing the patch antenna on the mounting board; and melting the third solder by heat such that the feed pin falls in the through-hole and that the lower end of the feed pin comes into contact with the feed pad.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 3 includes process drawings of a method of making the patch antenna in FIG. 1.

FIG. 4 includes process drawings of a method of mounting the patch antenna in FIG. 1.

FIG. 7 includes process drawings of a method of making the patch antenna in FIG. 6.

FIG. 8 includes process drawings of a method of mounting the patch antenna in FIG. 6.

DESCRIPTION OF THE PREFERRED EMBODIMENTS

The embodiments of the present invention are described below with reference to the attached drawings.

First Embodiment

Figure 1:
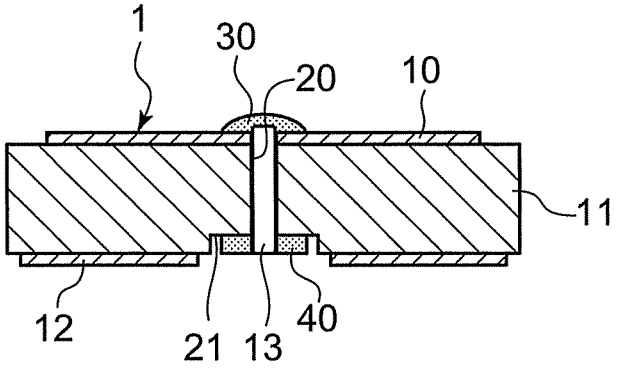
FIG. 1 is a cross-sectional view of a patch antenna according to a first embodiment of the present invention.

FIG. 1 is a cross-sectional view of a patch antenna 1.

The patch antenna 1 includes a radiation electrode 10, a dielectric substrate 11, and a ground electrode 12.

The dielectric substrate 11 is composed of, for example, a ceramic material. The dielectric substrate 11 is provided with a vertical through-hole 20 and a recess 21 that is open downward, has the inner periphery greater than the diameter of the through-hole 20, and is connected to the through-hole 20.

The radiation electrode 10 is provided on the upper surface of the dielectric substrate 11. The radiation electrode 10 is formed by screen printing or transfer printing that involves, for example, application of a paste material for an electrode to the dielectric substrate 11 followed by baking it. The shape and area of the radiation electrode 10 are determined in view of required operation frequencies and antenna characteristics. In the case of an antenna having circular polarization characteristics, for instance, a cutout is provided in the outer periphery of the radiation electrode 10.

The ground electrode 12 is provided on the lower surface of the dielectric substrate 11. The ground electrode 12 is also formed by screen printing or transfer printing that involves, for example, application of a paste material for an electrode to the dielectric substrate 11, followed by baking it.

A feed pin 13 is composed of, for example, brass and has a bar shape as a whole. The feed pin 13 is inserted into the through-hole 20. The upper end portion of the feed pin 13 projects from the upper surface of the radiation electrode 10. The upper end portion of the feed pin 13 is electrically connected to the radiation electrode 10 through solder 30. The solder 30 herein is a high-melting-point solder, for example.

Figure 2:
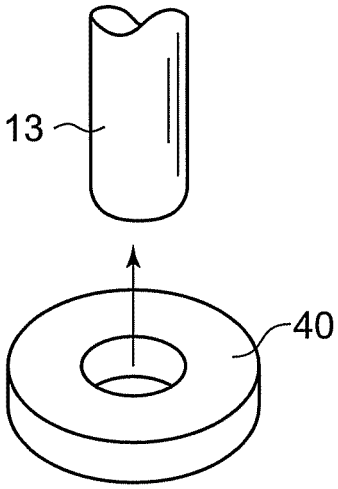
FIG. 2 is a perspective view of a feed pin and solder for illustrating how to apply the solder in the patch antenna of FIG. 1.

The lower end portion of the feed pin 13 is arranged inside the recess 21. The lower end portion of the feed pin 13 is provided with solder 40 (first solder). The solder 40 is provided, as shown in FIG. 2, for instance, by externally fitting a ring-shaped solid solder as the solder 40 to the lower end portion of the feed pin 13. The solder 40 is a low-melting-point solder having a lower melting point than the solder 30. The volume of the solder 40 is determined such that the melted solder sags from the lower end portion of the feed pin 13 and projects from the lower surface of the ground electrode 12.

The lower end of the feed pin 13 and the lower end of the solder 40 are flush with or above the lower surface of the ground electrode 12. Accordingly, the feed pin 13 and the solder 40 are protected by a wall surrounding them and thus do not undergo impulsion by some external object during transportation of the patch antenna 1.

A method of producing the patch antenna 1 is explained below with reference to FIGS. 3A to 3E.

Figure 3A:
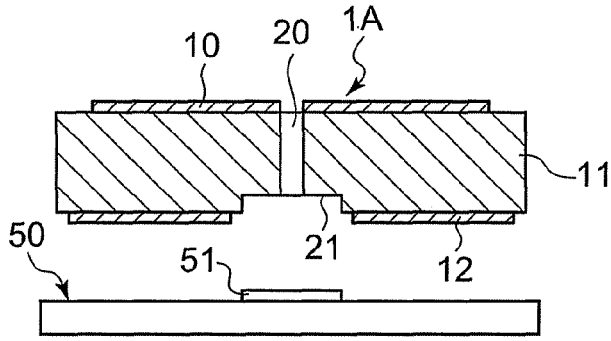
FIG. 3A illustrates a state of an antenna main body that is to be placed on a table.

With reference to FIG. 3A, an antenna main body 1A is used as a starting material in the method. The antenna main body 1A herein refers to a component including a radiation electrode 10, a dielectric substrate 11 having a through-hole 20 and a recess 21, and a ground electrode 12.

In the method, a table 50 is used on which the antenna main body 1A is to be placed, as shown in FIG. 3A. A projection 51 is provided on the upper surface of the table 50. The projection 51 is provided in a portion opposite to the recess 21 of the antenna main body 1A and slightly projects from the upper surface of the table 50. The other portion of the upper surface of the table 50 is flat. The upper surface of the projection 51 is also flat. The projection 51 is provided to position the lower end of the feed pin 13 above the lower surface of the ground electrode 12.

Figure 3B:
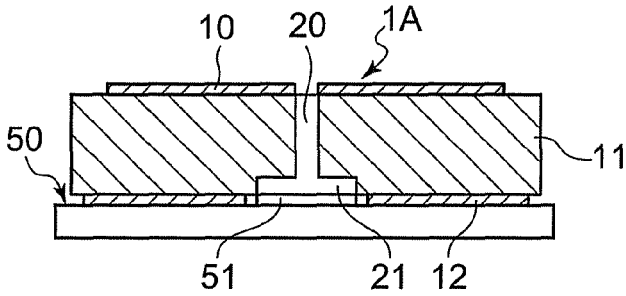
FIG. 3B illustrates a state after the antenna main body is placed on the table.

In production of the patch antenna 1, the antenna main body 1A is placed on the table 50 such that the ground electrode 12 faces downward, as shown in FIG. 3A. In the placed state, the projection 51 of the table 50 and the recess 21 are positioned such that their flat surfaces are aligned, as shown in FIG. 3B.

Figure 3C:
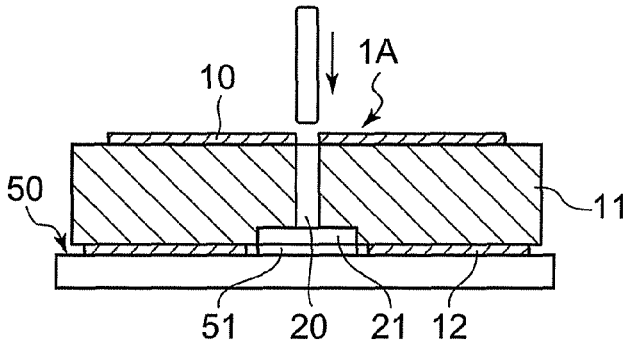
FIG. 3C illustrates a state of a feed pin that is to be inserted into a through-hole of the antenna main body.

With reference to FIG. 3C, the feed pin 13 is subsequently inserted from above into the through-hole 20 of the antenna main body 1A. Then, the lower end of the feed pin 13 is put into contact with the upper surface of the projection 51. In a state where the lower end of the feed pin 13 is in contact with the upper surface of the projection 51, the upper end portion of the feed pin 13 projects from the upper surface of the radiation electrode 10. The lower end of the feed pin 13 is positioned above the lower surface of the ground electrode 12.

Figure 3D:
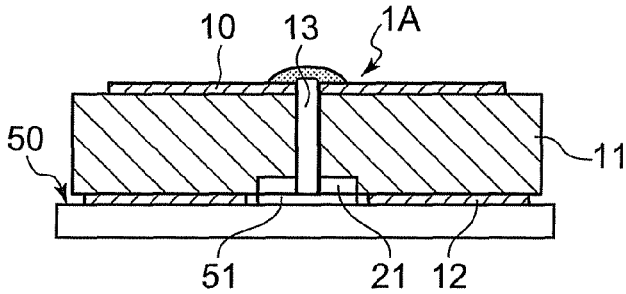
FIG. 3D illustrates a state after the feed pin and a radiation electrode are electrically connected to each other.

In this state, a solder 30 is applied to the upper surface of the antenna main body 1A and is melted by heat. Thus, the upper end portion of the feed pin 13 and the radiation electrode 10 are electrically connected to each other, as shown in FIG. 3D.

Figure 3E:
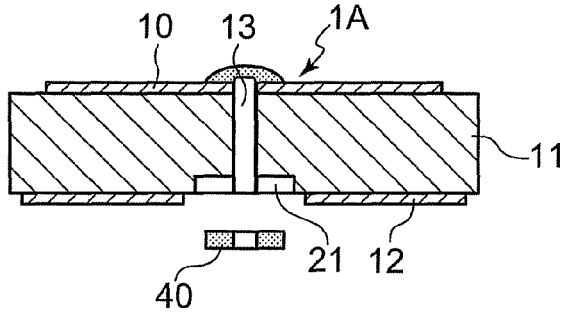
FIG. 3E illustrates a state of solder that is to be applied to the feed pin.

After the solder 30 is solidified, the antenna main body 1A is removed from the table 50. A solder 40, which is a ring-shaped solid solder prepared in advance, is then externally fitted to the lower end portion of the feed pin 13 positioned in the recess 21, as shown in FIGS. 2 and 3E. In the externally-fitted state, the lower end of the solder 40 is positioned so as to be flush with or above the lower surface of the ground electrode 12.

Thereby, the patch antenna 1 shown in FIG. 1 is produced.

Although the table 50 having the projection 51 on the upper surface thereof is used in the method described above, the table 50 may have a flat upper surface with no projection. In this case, the lower end of the feed pin 13 inserted into the through-hole 20 of the dielectric substrate 11 is put into contact with the upper surface of the table 50, and then the lower end of the feed pin 13 is flush with the lower surface of the ground electrode 12.

Further, in the above-mentioned method, the feed pin 13 is inserted into the through-hole 20 after the antenna main body 1A is placed on the table 50 in the method. Alternatively, the feed pin 13 may be inserted into the through-hole 20 of the antenna main body 1A from above or below before the antenna main body 1A is placed on the table 50. Thereafter, the antenna main body 1A may be placed on the table 50, and then the lower end of the feed pin 13 may be put into contact with the projection 51.

Alternatively, the solder 40 may be applied to the feed pin 13, which may then be inserted from below into the through-hole 20 of the antenna main body 1A before the antenna main body 1A is placed on the table 50. Thereafter, the antenna main body 1A may be placed on the table 50.

Subsequently, a method of mounting the patch antenna 1 is explained.

Figure 4A:
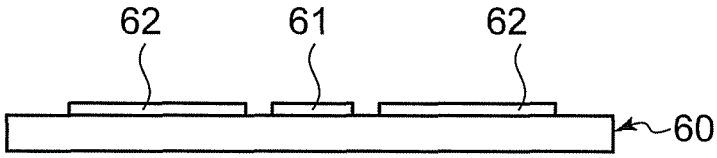
FIG. 4A is a front view of a mounting board to be used in the mounting process.

A mounting board 60 as shown in FIG. 4A is used in the mounting process. The mounting board 60 includes, on its upper surface, a feed pad 61 to be electrically connected to the feed pin 13 and a ground electrode 62 to be electrically connected to the ground electrode 12.

Figure 4B:
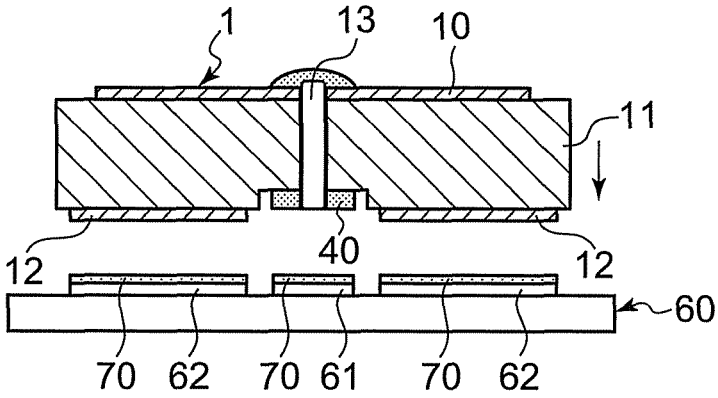
FIG. 4B illustrates a state of an antenna main body that is to be placed on the mounting board.

To mount the patch antenna 1, cream solder 70 (second solder) is applied to the feed pad 61 and the ground electrode 62 of the mounting board 60, as shown in FIG. 4B.

Figure 4C:
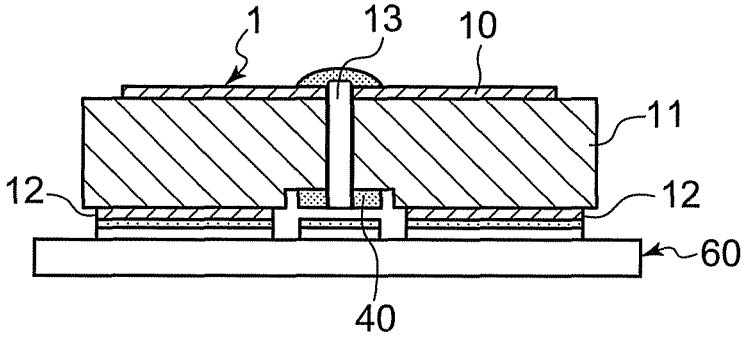
FIG. 4C illustrates a state after the antenna main body is placed on the mounting board.

Then, the lower end of the feed pin 13 and the solder 40 are positioned so as to face the feed pad 61 of the mounting board 60. The patch antenna 1 is then placed on the mounting board 60, as shown in FIG. 4C. At this point, the lower end of the feed pin 13 and the lower end of the solder 40 do not need to be in contact with the cream solder 70.

Subsequently, in the state of FIG. 4C, the mounting board 60 and the patch antenna 1 are placed into a reflow furnace so that the solder 40 and the cream solder 70 are melted.

In this process, the solder 40 applied to the feed pin 13 functions as below.

Figure 5:
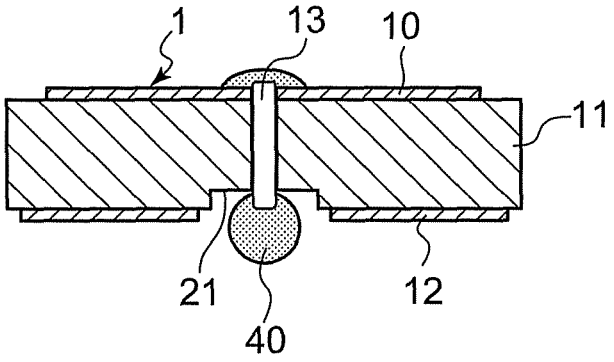
FIG. 5 illustrates a state after the solder applied to the feed pin of the patch antenna of FIG. 1 is melted.

FIG. 5 illustrates the melted state of the solder 40 in the case where no mounting board 60 is provided therebelow.

The solder 40 melts at temperatures exceeding the melting point. The solder 40 sags in a spherical shape at the lower end portion of the feed pin 13 due to the gravity exerted on the solder 40 and the surface tension of the solder 40. The lower end of the solder 40 is positioned below the lower end of the feed pin 13 in the melted state.

Figure 4D:
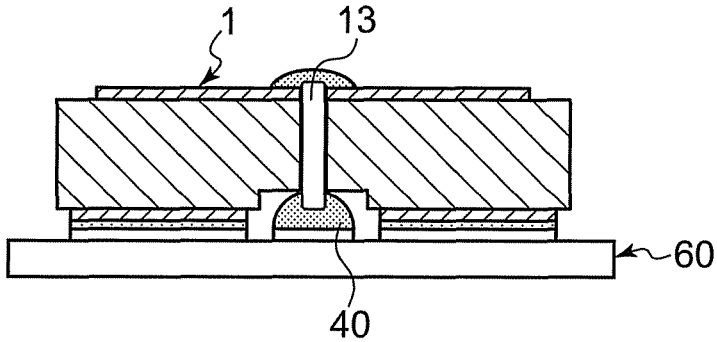
FIG. 4D illustrates a state after a feed pin and a feed pad are electrically connected to each other.

As described above, the lower end of the melted solder 40 is positioned below the lower end of the feed pin 13. Accordingly, the solder 40 is surely connected to the cream solder 70, as shown in FIG. 4D, thus forming a preferable solder fillet.

This leads to electrical connection of the lower end portion of the feed pin 13 of the patch antenna 1 to the feed pad 61.

The cream solder 70 also electrically connects the ground electrode 12 of the patch antenna 1 to the ground electrode 62 of the mounting board 60.

Although mounting only the patch antenna 1 on the mounting board 60 was explained in the embodiment described above, electric components, such as resistors and ICs, may also be mounted with solder on the upper surface of the mounting board 60 on which the patch antenna 1 is to be mounted. In this case, solder for mounting the electric components is melted together in the reflow furnace, so that the patch antenna 1 and the other electric components are mounted concurrently. This enhances workability in the overall mounting process.

The patch antenna 1 and the method of producing the same provide the following advantageous effects.

Specifically, the lower end of the feed pin 13 and the lower end of the solder 40 are flush with or above the lower surface of the ground electrode 12 in the embodiment. Thus, the lower end portion of the feed pin 13 is protected by a wall surrounding it and does not undergo impulsion by some external object during transportation of the patch antenna 1. Accordingly, the lower end portion of the feed pin 13 is not damaged.

Due to the same reason, the lower end of the feed pin 13 does not come into contact with the feed pad 61 before the other portions of the patch antenna 1 come into contact therewith when the patch antenna 1 is placed on the mounting board 60, thus preventing damaging of the feed pad 61 and tilting of the patch antenna 1.

Meanwhile, the melted solder 40 sags from the feed pin 13 as being attached thereto due to the gravity exerted on the solder 40 and the surface tension of the solder 40. The lower end of the solder 40 projects below the lower end of the feed pin 13. A preferable solder fillet is thus formed between the lower end portion of the feed pin 13 and the feed pad 61, ensuring electric connection between the feed pin 13 and the feed pad 61.

The first embodiment of the present invention is explained as above. The present invention, however, is not limited to the embodiment and may be modified in a variety of ways without deviating from the concept of the invention.

For instance, solders different from each other in types and materials are used as the solders 30 and 40, respectively, in the first embodiment; that is, a high-melting-point solder as the solder 30 and a low-melting-point solder as the solder 40. The present invention, however, does not require the solders different from each other in types and materials, provided melting temperatures thereof are different from each other such that the solder 30 does not melt while the solder 40 melts.

Conversely, the solder 30 may have a melting point similar to that of the solder 40 such that the solder 30 and the solder 40 melt simultaneously. In this case, although it is expected that the melting of the solder 30 lowers the feed pin 13 due to the self-gravity, the patch antenna 1 is not tilted relative to the mounting board 60. That is because the feed pin 13 is merely lowered at the melting of the solder.

Further, in the first embodiment, the cream solder 70 is applied to the feed pad 61 to electrically connect the feed pin 13 and the feed pad 61 to each other. However, in the case where the feed pad 61 has good wettability, it is unnecessary to apply the cream solder 70. Conversely, in the case where the feed pad 61 has poor wettability, it may be sufficient to clean its surface with flux.

Further, although the cream solder 70 is used to electrically connect the ground electrode 12 of the patch antenna 1 and the ground electrode 62 of the mounting board 60 to each other in the first embodiment, such electric connection is not always necessary. Instead of the cream solder 70, a thermosetting adhesive may be used to bond the ground electrode 12 of the patch antenna 1 and the ground electrode 62 of the mounting board 60 to each other.

Still further, in the first embodiment, solder in the solid form at normal temperature, which is relatively easy to handle, is used as the solder 40 to be applied to the feed pin 13. However, solder of any kind may be applied to the feed pin 13, provided the solder has certain viscosity at normal temperature and does not sag from the lower end portion of the feed pin 13 at normal temperature.

Second Embodiment

A second embodiment of the present invention is described below with reference to the attached drawings.

Figure 6:
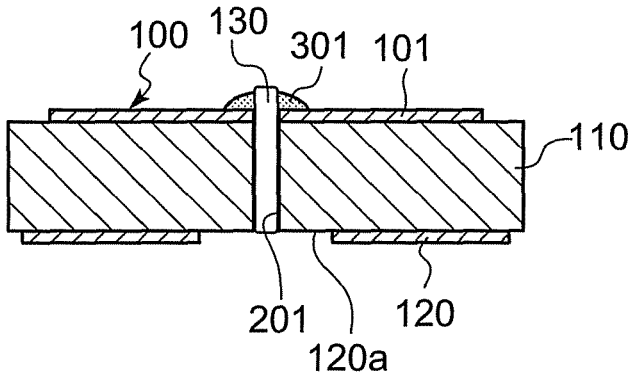
FIG. 6 is a cross-sectional view of a patch antenna according to a second embodiment of the present invention.

FIG. 6 is a cross-sectional view of a patch antenna 100 used in a method according to the second embodiment.

The patch antenna 100 includes a radiation electrode 101, a dielectric substrate 110, and a ground electrode 120.

The dielectric substrate 110 is composed of, for example, a ceramic material. The dielectric substrate 110 is provided with a vertical through-hole 201.

The radiation electrode 101 is provided on the upper surface of the dielectric substrate 110. The radiation electrode 101 is formed by screen printing or transfer printing that involves, for example, application of a paste material for an electrode to the dielectric substrate 110 followed by baking it. The shape and area of the radiation electrode 101 are determined in view of required operation frequencies and antenna characteristics. In the case of an antenna having circular polarization characteristics, for instance, a cutout is provided in the outer periphery of the radiation electrode 101.

The ground electrode 120 is provided on the lower surface of the dielectric substrate 110. The ground electrode 120 is also formed by screen printing or transfer printing that involves, for example, application of a paste material for an electrode to the dielectric substrate 110 followed by baking it.

A feed pin 130 is composed of, for example, brass and has a bar shape as a whole. The feed pin 130 is inserted into the through-hole 201. The upper end portion of the feed pin 130 projects from the upper surface of the radiation electrode 101. The upper end portion of the feed pin 130 is temporarily fixed in a state of being electrically connected to the radiation electrode 101 through solder 301 (third solder).

When the feed pin 130 is temporarily fixed, the lower end of the feed pin 130 is flush with or above the lower surface of the ground electrode 120. Accordingly, the lower end portion of the feed pin 130 is protected by a wall surrounding it and thus does not undergo impulsion by some external object during transportation of the patch antenna 100.

A method of producing a patch antenna 100 is explained below with reference to FIGS. 7A to 7D.

Figure 7A:
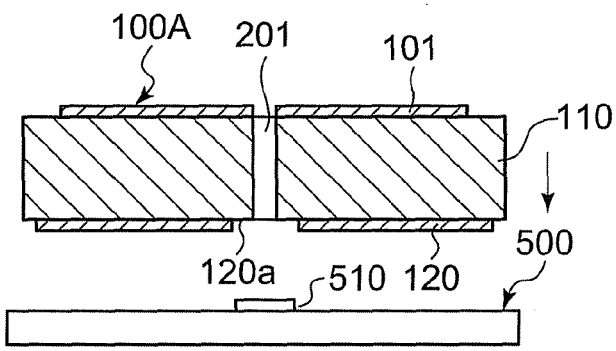
FIG. 7A illustrates a state of an antenna main body that is to be placed on a table.

With reference to FIG. 7A, an antenna main body 100A is used as a starting material in the method. The antenna main body 100A herein refers to a component including a radiation electrode 101, a dielectric substrate 110 having a through-hole 201, and a ground electrode 120.

In the method, a table 500 is used on which the antenna main body 100A is to be placed, as shown in FIG. 7A. A projection 510 is provided on the upper surface of the table 500. The projection 510 is provided in a portion opposite to a cutout portion 120*a* of the ground electrode 120 proximate to the through-hole 201 of the antenna main body 100A and slightly projects from the upper surface of the table 500. The other portion of the upper surface of the table 500 is flat. The upper surface of the projection 510 is also flat. The projection 510 is provided to position the lower end of a feed pin 130 above the lower surface of the ground electrode 120.

Figure 7B:
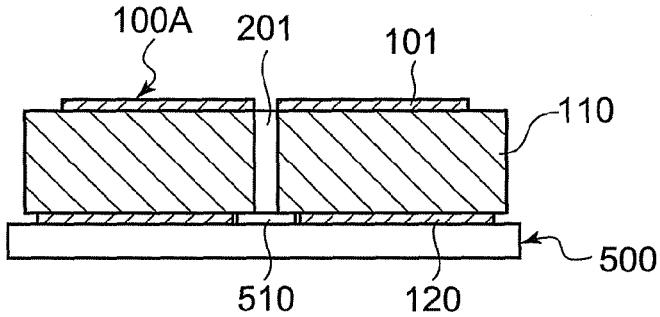
FIG. 7B illustrates a state after the antenna main body is placed on the table.

In production of the patch antenna 100, the antenna main body 100A is placed on the table 500 such that the ground electrode 120 faces downward, as shown in FIG. 7A. In the placed state, the projection 510 of the table 500 and the cutout portion 120*a* of the ground electrode 120 are positioned such that their flat surfaces are aligned, as shown in FIG. 7B.

Figure 7C:
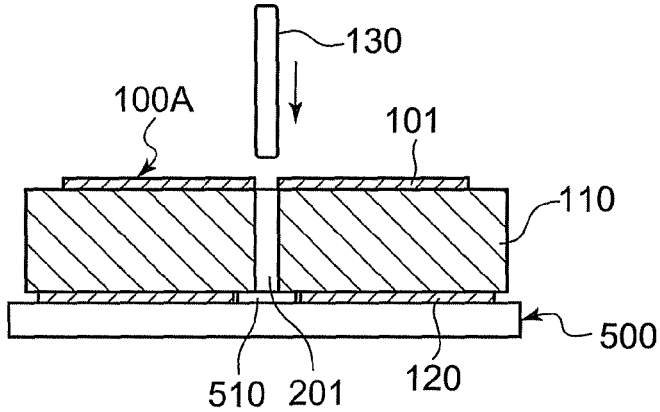
FIG. 7C illustrates a state of a feed pin that is to be inserted into a through-hole of the antenna main body.

With reference to FIG. 7C, the feed pin 130 is subsequently inserted from above into the through-hole 201 of the antenna main body 100A. Then, the lower end of the feed pin 130 is put into contact with the upper surface of the projection 510. In a state where the lower end of the feed pin 130 is in contact with the upper surface of the projection 510, the upper end portion of the feed pin 130 projects from the upper surface of the radiation electrode 101. The lower end of the feed pin 130 is positioned above the lower surface of the ground electrode 120.

Figure 7D:
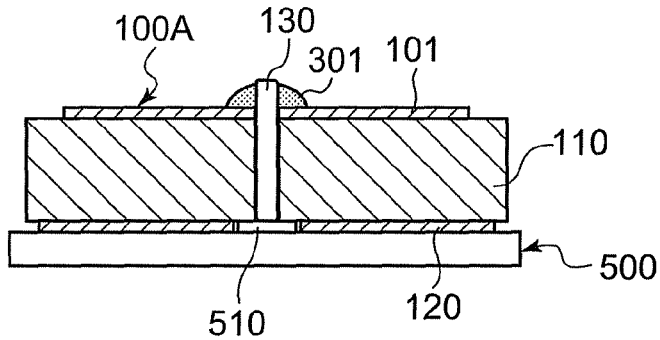
FIG. 7D illustrates a state after a radiation electrode and the feed pin are electrically connected to each other.

In this state, the solder 301 is applied to the upper surface of the antenna main body 100A and is melted by heat. Then, the feed pin 130 is temporarily fixed, with the upper end portion of the feed pin 130 electrically connected to the upper surface of the radiation electrode 101 through the solder 301, as shown in FIG. 7D. Thereby, the patch antenna 100 shown in FIG. 6 is produced.

In the method described above, the table 500 having the projection 510 on the upper surface thereof is used. Alternatively, the table 500 may have a flat upper surface without a projection. In this case, the lower end of the feed pin 130 inserted into the through-hole 201 of the dielectric substrate 110 is put into contact with the upper surface of the table 500, and then the lower end of the feed pin 130 is flush with the lower surface of the ground electrode 120.

Further, in the method described above, the feed pin 130 is inserted into the through-hole 201 after the antenna main body 100A is placed on the table 500. Alternatively, the feed pin 130 may be inserted into the through-hole 201 of the antenna main body 100A from above or below before the antenna main body 100A is placed on the table 500. Thereafter, the antenna main body 100A may be placed on the table 500, and then the lower end of the feed pin 130 may be put into contact with the projection 510.

Subsequently, a method of mounting the patch antenna 100 is explained.

Figure 8A:
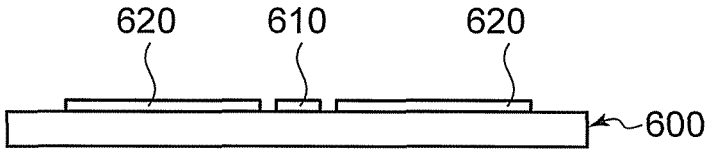
FIG. 8A is a front view of a mounting board to be used in the mounting process.

A mounting board 600 as shown in FIG. 8A is used in the mounting process. The mounting board 600 includes, on its upper surface, a feed pad 610 to be electrically connected to the feed pin 130 and a ground electrode 620 to be electrically connected to the ground electrode 120.

Figure 8B:
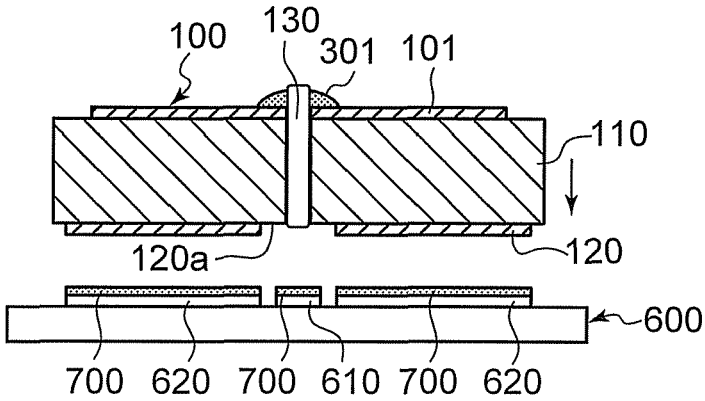
FIG. 8B illustrates a state of an antenna main body that is to be placed on the mounting board.

To mount the patch antenna 100, cream solder 700 (fourth solder) is applied to the feed pad 610 and the ground electrode 620 of the mounting board 600, as shown in FIG. 8B.

Figure 8C:
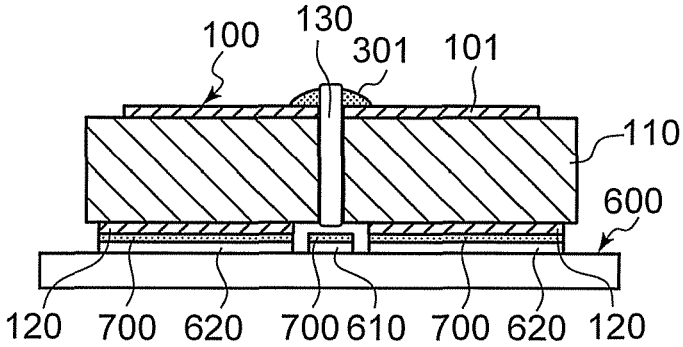
FIG. 8C illustrates a state after the antenna main body is placed on the mounting board.
Figure 8D:
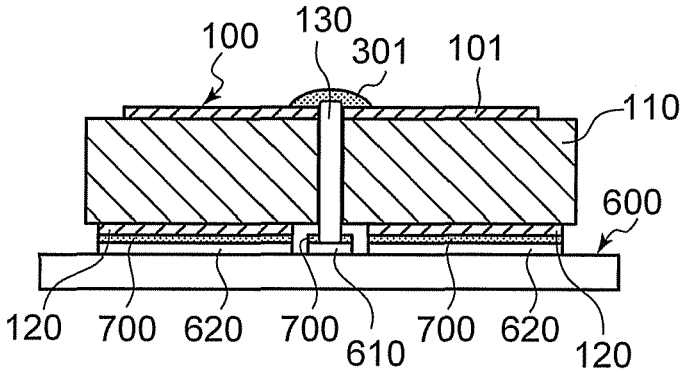
FIG. 8D illustrates a state after a lower end portion of a feed pin and the feed pad of the mounting board are electrically connected to each other.

Then, the lower end of the feed pin 130 and the feed pad 610 of the mounting board 600 are positioned so as to face each other. The patch antenna 100 is then placed on the mounting board 600, as shown in FIG. 8C. At this point, the lower end of the feed pin 130 does not need to be in contact with the cream solder 700.

Subsequently, in the state of FIG. 8C, the mounting board 600 and the patch antenna 100 are placed into a reflow furnace, so that the solder 301 and the cream solder 700 are melted.

In this process, the solder 301 functions as below.

The melted solder 301 loses retention of the feed pin 130. Thus, the feed pin 130 falls in the through-hole 201 due to the self-weight and projects from the lower surface of the ground electrode 120.

As described above, the feed pin 130 projects from the lower surface of the ground electrode 120 and is in tight contact with the feed pad 610. Accordingly, the melted solder climbs along the feed pin 130, thus forming a preferable solder fillet.

This leads to electrical connection of the lower end portion of the feed pin 130 of the patch antenna 100 to the second feed pad 610.

The cream solder 700 also electrically connects the ground electrode 120 of the patch antenna 100 to the ground electrode 620 of the mounting board 600.

Although mounting only the patch antenna 100 on the mounting board 600 was explained in the embodiment described above, electric components, such as resistors and ICs, may also be mounted with solder on the upper surface of the mounting board 600 on which the patch antenna 100 is to be mounted. In this case, solder for mounting the electric components is melted together in the reflow furnace, so that the patch antenna 100 and the other electric components are mounted concurrently. This enhances workability in the overall mounting process.

The patch antenna 100 and the method of producing the same provide the following advantageous effects.

Specifically, the lower end of the feed pin 130 is flush with or above the lower surface of the ground electrode 120 in the embodiment. Thus, the lower end portion of the feed pin 130 is protected by a wall surrounding it and does not undergo impulsion by some external object during transportation of the patch antenna 100. Accordingly, the lower end portion of the feed pin 130 is not damaged.

Due to the same reason, the lower end of the feed pin 130 does not come into contact with the feed pad 610 before the other portions of the patch antenna 100 come into contact therewith when the patch antenna 100 is placed on the mounting board 600, thus preventing damaging of the feed pad 610 and tilting of the patch antenna 100.

Furthermore, the melted solder 301 in the mounting process lowers the feed pin 130, ensuring electric connection between the lower end portion of the feed pin 130 and the feed pad 610.

Third Embodiment

Figure 9:
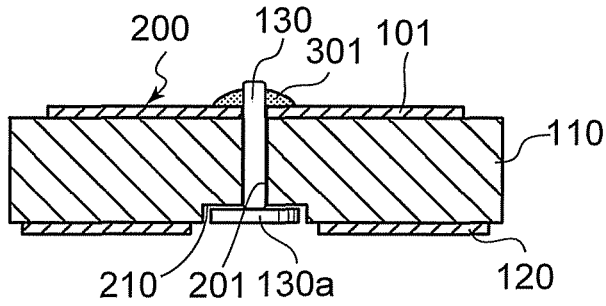
FIG. 9 is a cross-sectional view of a patch antenna according to a third embodiment of the present invention.

FIG. 9 is a cross-sectional view of a patch antenna 200 used in a method according to a third embodiment. The same components of the patch antenna 200 as those of the patch antenna 100 are denoted with the same reference numerals.

The dielectric substrate 110 of the patch antenna 200 has a recess 210 that is open downward, has the inner periphery greater than the diameter of a through-hole 201, and is connected to the through-hole 201.

A seat 130*a* extending to the entire circumference is provided in the lower end of the feed pin 130 of the patch antenna 200. The lower end of the seat 130*a* of the feed pin 130 is flush with or above the lower surface of a ground electrode 120 when the feed pin 130 is temporarily fixed.

The patch antenna 200 is produced in the same manner as the patch antenna 100. Since the seat 130*a*, however, is provided in the feed pin 130, the feed pin 130 should be inserted from below into the through-hole 201 before an antenna main body 100A is placed on a table 500.

Figure 10:
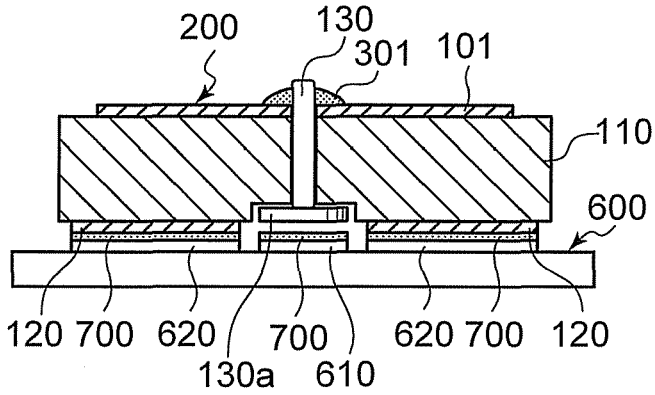
FIG. 10 illustrates a state after the patch antenna of FIG. 9 is placed on a mounting board.
Figure 11:
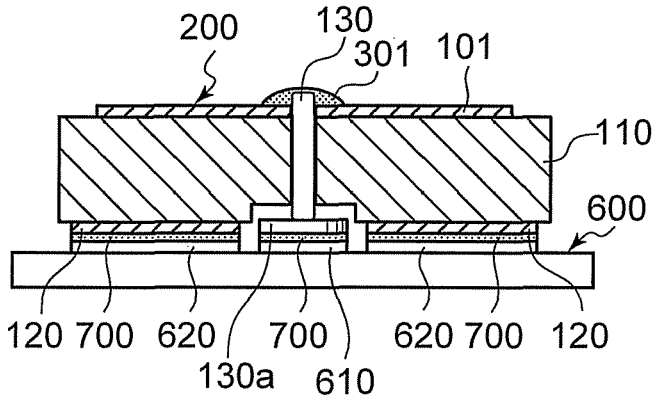
FIG. 11 illustrates a state after the patch antenna of FIG. 9 is mounted on the mounting board.

The patch antenna 200 is mounted also in the same manner as the patch antenna 100. FIG. 10 illustrates a state after the patch antenna 200 is placed on a mounting board 600. FIG. 11 illustrates a state after the patch antenna 200 is mounted on the mounting board 600. In FIGS. 10 and 11, the components same as those of the mounting board 600 are denoted with the same reference numerals.

The method of mounting the patch antenna 200 provides the same effects as those of the method of mounting the patch antenna 100. In addition, the seat 130*a* of the feed pin 130 allows a wider contact between the lower end portion of the feed pin 130 and a feed pad 610, as shown in FIG. 11.

The seat 130*a* also functions as a weight, facilitating the falling of the feed pin 130.

Fourth Embodiment

Figure 12:
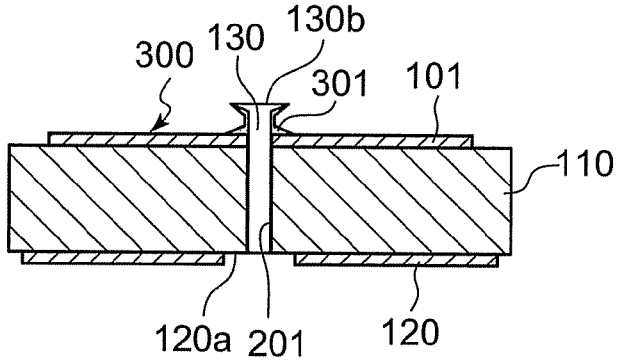
FIG. 12 is a cross-sectional view of a patch antenna according to a fourth embodiment of the present invention.

FIG. 12 is a cross-sectional view of a patch antenna 300 used in a method according to a fourth embodiment. The same components of the patch antenna 300 as those of the patch antenna 100 are denoted with the same reference numerals.

A head 130*b* extending to the entire circumference is provided in the upper end portion of the feed pin 130 of the patch antenna 300. The lower surface of the head 130*b* is tapered. Solder 301 is applied from the head 130*b* to an upper surface of a radiation electrode 101, and the feed pin 130 is temporarily fixed. When the feed pin 130 is temporarily fixed, the lower end of the feed pin 130 is flush with or above the lower surface of a ground electrode 120.

The patch antenna 300 is produced in the same manner as the patch antenna 100. Since the head 130*b*, however, is provided in the feed pin 130, the feed pin 130 should be inserted from above into a through-hole 201.

Figure 13:
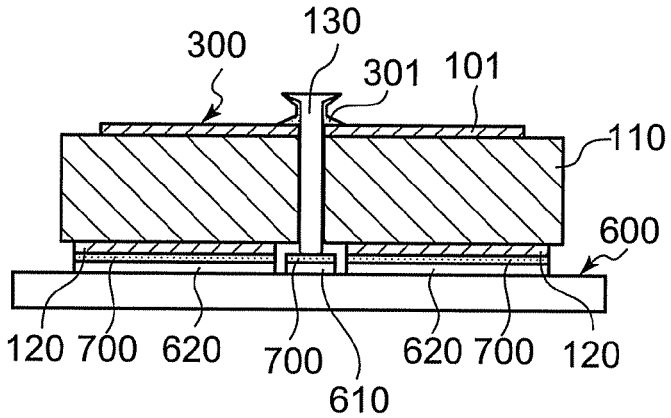
FIG. 13 illustrates a state after the patch antenna of FIG. 12 is placed on a mounting board.
Figure 14:
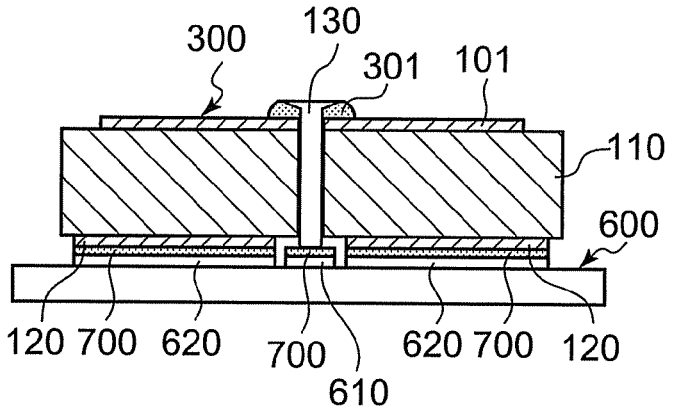
FIG. 14 illustrates a state after the patch antenna of FIG. 12 is mounted on the mounting board.

The patch antenna 300 is mounted also in the same manner as the patch antenna 100. FIG. 13 illustrates a state after the patch antenna 300 is placed on a mounting board 600. FIG. 14 illustrates a state after the patch antenna 300 is mounted on the mounting board 600. In FIGS. 13 and 14, the components same as those of the mounting board 600 are denoted with the same reference numerals.

The method of mounting the patch antenna 300 provides the same effects as those of the method of mounting the patch antenna 100. In addition to the gravity, the surface tension of the solder 301 pulls the feed pin 130 inside the through-hole 201, thus facilitating the falling of the feed pin 130.

The embodiments of the present invention are explained as above. The present invention, however, is not limited to the embodiments and may be modified in a variety of ways without deviating from the concept of the invention.

Further, although the cream solder 700 is used to electrically connect the ground electrode 120 of the patch antenna 100 and the ground electrode 620 of the mounting board 600 to each other in the embodiment above, such an electric connection is not always necessary. Instead of the cream solder 700, a thermosetting adhesive may be used for bonding.

What is claimed is:

1. A patch antenna comprising:

a dielectric substrate having a vertical through-hole and a recess that is open downward, the recess having an inner periphery greater than a diameter of the through-hole, the recess being connected to the through-hole;

a radiation electrode provided on an upper surface of the dielectric substrate;

a ground electrode provided on a lower surface of the dielectric substrate; and a feed pin inserted into the through-hole such that a lower end portion of the feed pin is arranged inside the recess, the feed pin electrically connected to the radiation electrode through an upper end portion of the feed pin, wherein first solder is applied to the lower end portion of the feed pin, and a lower end of the feed pin and a lower end of the first solder are flush with or above a lower surface of the ground electrode, wherein the feed pin has a bar shape in the lower end portion, and the first solder is a ring-shaped solid solder externally fitted to the lower end portion of the feed pin.

2. A method of mounting the patch antenna according to claim 1, the method comprising:

placing the patch antenna on a mounting board having a feed pad on an upper surface thereof; and melting the first solder by heat to electrically connect the lower end portion of the feed pin and the feed pad to each other.

3. The method of mounting the patch antenna according to claim 2, wherein a feed pad to which second solder is applied is provided on the mounting board in a position opposite to the ground electrode of the patch antenna, and the first solder and the second solder are melted simultaneously.

4. A method of mounting a patch antenna on a mounting board, the patch antenna comprising a dielectric substrate having a vertical through-hole, a radiation electrode provided on an upper surface of the dielectric substrate, a ground electrode provided on a lower surface of the dielectric substrate, and a feed pin inserted into the through-hole;

by electrically connecting a lower end portion of the feed pin to a feed pad provided on an upper surface of the mounting board, the method comprising:

setting a length of the feed pin such that an upper end portion thereof projects from an upper surface of the radiation electrode when a lower end of the feed pin comes into contact with the feed pad;

loosely fitting the feed pin into the through-hole;

temporarily fixing the feed pin by using third solder applied from the upper end portion of the feed pin to the radiation electrode in a state where the lower end of the feed pin is flush with or above a lower surface of the ground electrode;

placing the patch antenna on the mounting board; and melting the third solder by heat such that the feed pin falls in the through-hole and that the lower end of the feed pin comes into contact with the feed pad.

5. The method of mounting the patch antenna according to claim 4, wherein fourth solder is applied to the feed pad; the third solder and the fourth solder are simultaneously melted by heat; and the fourth solder electrically connects the lower end portion of the feed pin to the feed pad.

6. The method of mounting the patch antenna according to claim 4, wherein the dielectric substrate is provided with a recess that is open downward, that has an inner periphery greater than a diameter of the through-hole, and that is connected to the through-hole; the feed pin has a seat extending to an entire circumference of the feed pin in the lower end thereof; and, when the feed pin is temporarily fixed, a lower end of the seat is flush with or above the lower surface of the ground electrode.

7. The method of mounting the patch antenna according to claim 4, wherein the feed pin has a head extending to an entire circumference in the upper end portion thereof; and the feed pin is temporarily fixed by using the third solder applied from a lower surface of the head to the radiation electrode.

* * * * *